US008067095B1

(12) United States Patent
Beckworth et al.

(10) Patent No.: US 8,067,095 B1
(45) Date of Patent: Nov. 29, 2011

(54) AWARD OR TROPHY APPARATUS, METHOD OF MAKING, AND METHOD OF OFFERING AN AWARD OR TROPHY FOR SALE WHEREIN DYNAMIC MOVEMENT OF A GAME PIECE AND OR BODY PART IS INDICATED

(76) Inventors: Willis Glenn Beckworth, Charlotte, NC (US); Jack Lee Ellis, Henrietta, TX (US); Gary Morton Levison, Atlanta, GA (US); Calvin Craig Miller, Topeka, IN (US); Mark Wynn Reifsnyder, Haddonfield, NJ (US); Barry Lee Tittsworth, Huntsville, AL (US)

( * ) Notice: Subject to any disclaimer, the term of this patent is extended or adjusted under 35 U.S.C. 154(b) by 380 days.

(21) Appl. No.: 12/372,805

(22) Filed: Feb. 18, 2009

Related U.S. Application Data

(60) Provisional application No. 61/031,633, filed on Feb. 26, 2008.

(51) Int. Cl.
*A47G 35/00* (2006.01)

(52) U.S. Cl. ..... 428/542.4; D11/131; D11/160; D11/164

(58) Field of Classification Search ..... 428/913.3, 428/542.4; D11/131, 156, 160–162, 164
See application file for complete search history.

(56) References Cited

U.S. PATENT DOCUMENTS

| | | | | | |
|---|---|---|---|---|---|
| D3,646 | S | * | 8/1869 | Muller | D11/161 |
| D166,157 | S | * | 3/1952 | Giovacchimi | D11/160 |
| D166,158 | S | * | 3/1952 | Giovacchimi | D11/160 |
| D167,046 | S | * | 6/1952 | Linder | D11/160 |
| D168,682 | S | * | 1/1953 | Frenzel | D11/160 |
| 3,699,698 | A | * | 10/1972 | Shiu | 40/419 |
| D248,548 | S | * | 7/1978 | Siegel | D11/160 |
| D296,426 | S | * | 6/1988 | Dannheiser | D11/160 |
| 5,322,739 | A | * | 6/1994 | Stagl | 428/542.4 |
| D351,814 | S | * | 10/1994 | Young et al. | D11/160 |
| 6,783,255 | B1 | * | 8/2004 | Tsang-Tse | 362/35 |

* cited by examiner

*Primary Examiner* — Cathy Lam
(74) *Attorney, Agent, or Firm* — Garvey, Smith, Nehrbass & North, LLC; Brett A. North

(57) ABSTRACT

A trophy or award which includes a statue or figurine shown in a position playing a sporting event with a game piece, and includes a member indicating dynamic movement of the game piece and/or a body part of the statue or figurine.

27 Claims, 11 Drawing Sheets

AWARD OR TROPHY APPARATUS, METHOD OF MAKING, AND METHOD OF OFFERING AN AWARD OR TROPHY FOR SALE WHEREIN DYNAMIC MOVEMENT OF A GAME PIECE AND OR BODY PART IS INDICATED

CROSS-REFERENCE TO RELATED APPLICATIONS

Priority of U.S. Provisional Patent Application Ser. No. 61/031,633, filed Feb. 26, 2008, incorporated herein by reference, is hereby claimed.

BACKGROUND

This application relates to awards, methods of making awards, and method of offer awards for sale. More particularly, this application concerns novel structures for statues, trophies, and medals used as awards.

It is commonly known to provide trophies including statues to participants in various types of contests and competition. Such statues may be mounted on a base having an engraved message with information about the contest and the type of award being given.

Statues used for trophies often depict a figure of one or more persons. In some instances, the figures depict likenesses of participants in a contest. Examples are shown in U.S. Design Pat. No. 293,221, along with U.S. Pat. No. 5,322,739, in which football players and a golfer are depicted in a pose during game play. Other such trophies may depict an object that is a part of the contest, such as in U.S. Design Pat. No. 293,220 showing a soccer players in a frozen pose during play, and U.S. Pat. No. 5,853,823 depicting a soccer ball.

Statues sometimes show inspiring, fictional or romantic figures that are meant to inspire, educate or stimulate imagination, rather than to depict a specific person or individual. An example is given in U.S. Design Pat. No. 312,058 showing an angel figurine. Often, a statue will depict a person in a heroic stance or depict a situation that is exaggerated in a heroic manner, again to inspire or depict excellence in some achievement.

However, such statues are shown in static positions, i.e., a snap shot of the action during or after game play. Up to now there has not been a statue or figurine which is in static form but tracks or depicts dynamic game play.

SUMMARY

In one embodiment is disclosed a statue or figurine that may be awarded as a trophy or award for winning or showing excellence in competition which statue tracks or depicts dynamic game play.

In one embodiment is disclosed a trophy or award which comprising a base and a statue or figurine mounted thereon. In one embodiment the statue or figurine includes a game piece and a movement member.

In various embodiments the sporting event depicted in the statue or figurine is depicts a player in one or more of the following sports: football, basketball, baseball, soccer, volley ball, hockey, tennis, racquetball, pole vaulting, track, high jumping, and/or long jumping.

In one embodiment the base includes at least a partial representation of a game piece of a sport. In one embodiment the base includes one half of a game piece. In one embodiment the statue or figurine mounted on the base includes a game piece of the same type and design as the game piece which is part of the base. In one embodiment the game piece included in the statue or figurine, and the game piece which is part of the base, are both colored to match the colors of game pieces in the professional sporting events for such game pieces.

In one embodiment, the statue or figurine for a sport comprises a game piece and a movement member, the movement member being coupled to the game piece and/or body part, wherein the movement member is an indicia of dynamic game play in the sport.

In one embodiment the movement member can be detachably connected to the game piece and/or body part. In one embodiment the movement member is permanently affixed to the game piece and/or body part. In one embodiment the movement member provides structural support for the statue or figurine attached to the base.

In one embodiment the movement member spans from the base to the statue or figurine.

In one embodiment the movement member tracks movement of the statue or figurine during game play.

In one embodiment the movement member follows the path of movement shown in the statue.

In one embodiment the statue or figurine includes a three dimensional figure where at least one part of the figure's movement is tracked by the movement member.

In one embodiment the movement member is indicia of and/or tracks past movement in the figure.

In one embodiment the movement member is indicia of and/or forecasts future movement in the figure.

In one embodiment the movement member is indicia of and/or forecasts a combination of past movement and future movement in the figure.

In one embodiment the movement member is indicia of and/or tracks movement from a first location to a second location.

In one embodiment the first and second locations are indicia of first and second locations of a game piece shown in the statue or figurine.

In one embodiment the first and second locations are indicia of first and second positions of a body part of the statue or figurine. In one embodiment the body part is a hand In one embodiment the body part is a foot.

In one embodiment the movement member includes a plurality of phantom positions of the game piece being held by the statue or figurine. In one embodiment 2, 3, 4, 5, 6, 7, 8, 9, and/or 10 phantom positions are shown. In various embodiments ranges between any two of the specified number of phantom positions are shown.

In one embodiment the movement member comprises two longitudinal portions: (a) a first portion relatively wide in a first direction and (b) a second portion relatively thin in a second direction, the first direction being substantially perpendicular to the second direction. In one embodiment a cross section through the movement member is about the shape of a rectangle. In one embodiment the shorter sides of the rectangle can be rounded.

In one embodiment the first portion becomes progressively larger as one moves from the first end of the movement member to the second end of the movement member. In one embodiment the first end is the starting portion of the movement member. In one embodiment the second end is the ending portion of the second portion.

In one embodiment the movement member includes a starting portion and an ending portion. In one embodiment the ending portion of the movement member is located adjacent to a game piece. In one embodiment the ending portion of the movement member is touching a body part of the statue or figurine, and the body part of the statue or figurine is touching the game piece.

In one embodiment the starting portion of the movement member approximates a point, and the ending portion of the movement member is about the size of the game piece to which the ending portion is located adjacent to.

In one embodiment the movement member at the second end is about as wide as the game piece which is located adjacent the second end of the movement member.

In one embodiment the movement member is in the shape of a swoosh having a longitudinal axis spanning from the starting point of the movement member to the ending point of the movement member, and which swoosh is at least partially twisted about this longitudinal axis.

In one embodiment the movement member passes out of any plane containing both the first end of the movement member and the second end of the movement member.

In one embodiment the movement member passes into, through, and out of a plane containing both the starting portion of the movement member and the ending portion of the movement member.

In one embodiment the movement member forms at least a partial helix. In one embodiment the helix is substantially vertical. In one embodiment the helix is substantially horizontal. In one embodiment the helix is substantially vertical where the indicia of movement in the statue or figurine is rotation about a substantially vertical axis In one embodiment the helix is substantially horizontal where the indicia of movement in the statue or figurine is rotation about a substantially horizontal axis.

In one embodiment the movement member is indicia of air motion resulting from movement of the game piece and/or a body part of the statue or figurine. In one embodiment the movement member is indicia of such wind movement. In one embodiment the movement member is indicia of water movement.

In one embodiment the movement member includes a plurality of arcs spaced about the first surface of the movement member.

In one embodiment the movement member includes a plurality of curvatures about its first end to its second end. In one embodiment the movement member includes a plurality of arcs spaced about the second surface of the movement member. In one embodiment the plurality of arcs have a plurality of curvatures, and the curvatures of each arc is substantially the same as the curvature of the movement member at the location of the movement member.

In one embodiment the movement member simulates air flow through space from a first location of a game piece to a second location of the game piece which is actually shown in the statue.

In one embodiment the movement member spans across three dimensions to simulate movement of a game piece and/or body part of the statue or figurine, such as x, y, and z dimensions in a Cartesian coordinate system.

In one embodiment the statue or figurine has a height with a middle, and the movement member spans both above and below the middle. In one embodiment the middle of the statue or figurine is a waist line.

In one embodiment the statue or figurine has a front and a rear, and the movement member spans from the rear to the front (or vice versa) of the statue or figurine.

In one embodiment the statue or figurine has a top, and looking from the top, the movement member appears to wrap around the statue or figurine by at least about the following ranges of percent: 30, 35, 40, 45, 50, 55, 60, 65, 70, 75, 80, 85, 90, 91, 92, 93, 94, 95, 96, 97, 98, 99, and 100. In various embodiments the wrap around can be a range between any two of the above specified percentages.

A method is also provided for making an award, comprising providing a game piece and/or body part, and connecting a movement member to the game piece and/or body part.

In another instance, a method is provided for making an award comprising providing a game piece and/or body part, providing a movement member connected to the game piece and/or body part, and displaying on the movement member a plurality of depictions of at least a portion the game piece and/or body part.

Other aspects and advantages of the present invention will become apparent from the following detailed description, which in conjunction with the accompanying drawings illustrates by way of example the principles of the present invention.

DETAILED DESCRIPTION

In one embodiment shown in FIGS. 1-35, a trophy or award 100 can include statue or figurine 300 mounted on a base 110. The statue or figurine 300 can depict an individual participating in a game or sporting event. The statue or figurine 300 can include a movement simulating member 1000 which provides an indicia of movement and/or dynamic game play by tracking at least part of the movement of a game piece 600 and/or body part (e.g., 432, 442, 452, and/or 462) of the statue or figurine 300.

In FIGS. 1-5, a basketball player is the figurine 300. Trophy or award 100 of FIGS. 1-5 shows the basketball player figurine 300 attempting to dunk a basketball game piece 600 and wherein the movements simulating member 1000 provides an indicia of movement and/or dynamic game play by tracking an arc shaped movement of the game ball or game piece 600 as it is held by the figurine 300.

Figure 6:
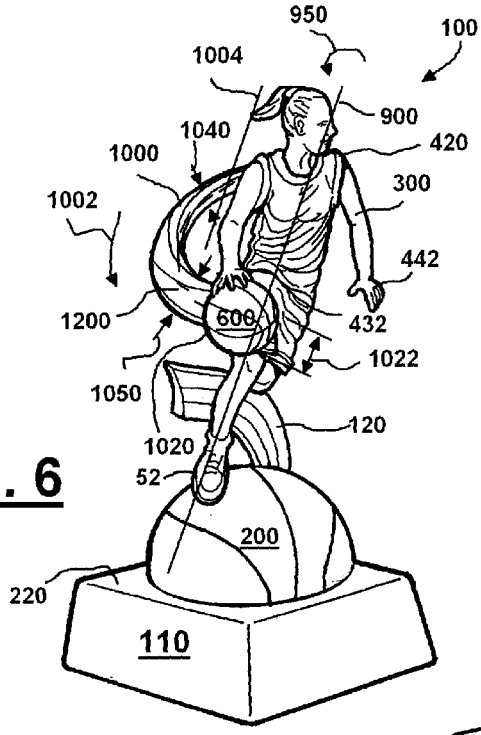
FIG. 6 is a front perspective view of a preferred embodiment of the apparatus of the present invention showing a female basketball player dribbling and making a turn.
Figure 7:
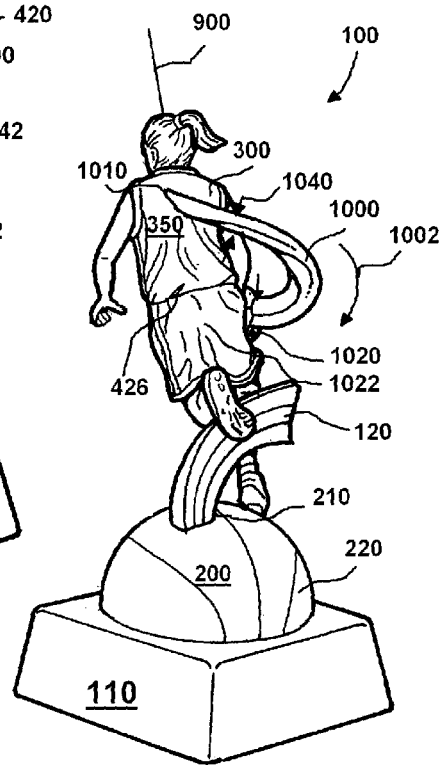
FIG. 7 is a rear perspective view of the embodiment of FIG. 6.
Figure 8:
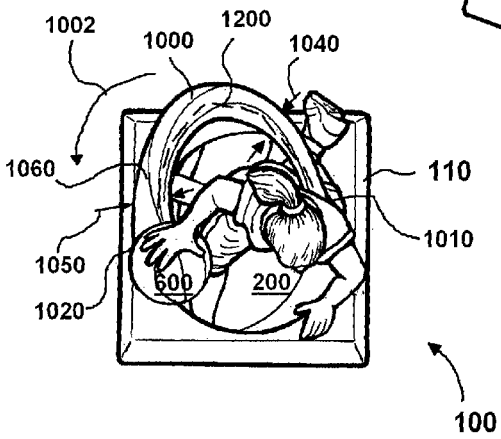
FIG. 8 is a top perspective view of the embodiment of FIG. 6.

In FIGS. 6-8, a female basketball player is the figurine 300 and wherein the movement simulating member 1000 illustrates movement of the ball or game piece 600 during dribbling.

Figure 9:
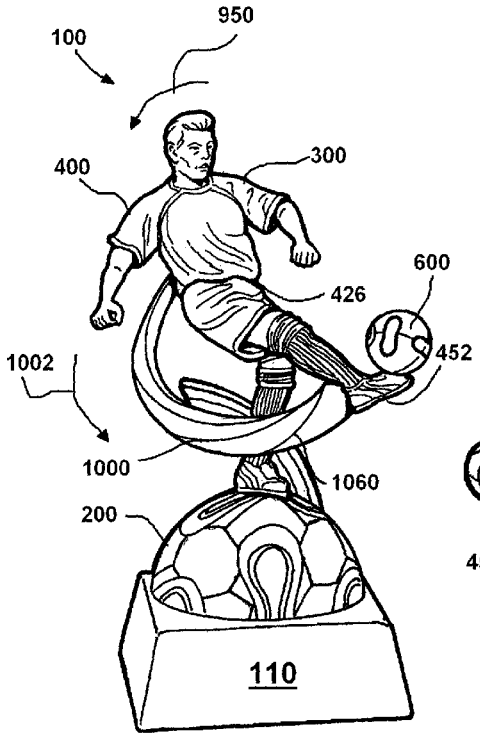
FIG. 9 is a front perspective view of a preferred embodiment of the apparatus of the present invention showing a trophy representing a male soccer player kicking a soccer ball while leaning or falling backwards.
Figure 10:
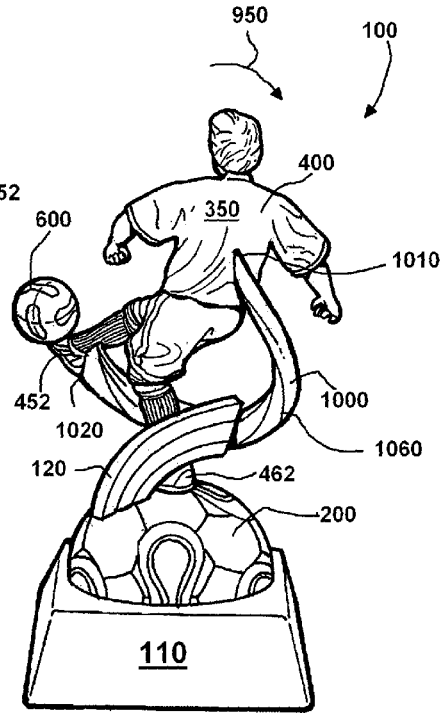
FIG. 10 is a rear perspective view of the embodiment of FIG. 9.
Figure 11:
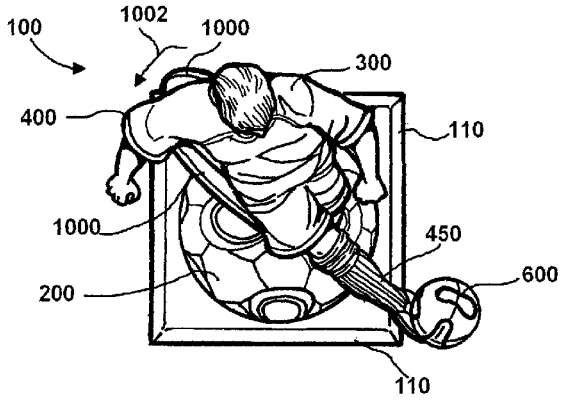
FIG. 11 is a top perspective view of the embodiment of FIG. 9.

In FIGS. 9-11, the figurine 300 is a male soccer player, wherein the movement simulating member 1000 simulates the figurine 300 kicking the game piece or soccer ball 600 with his foot 452.

Figure 12:
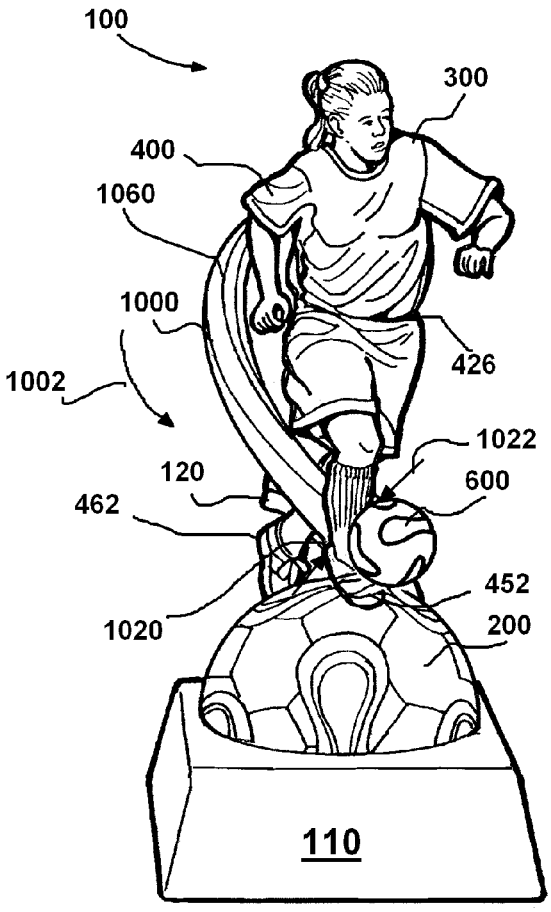
FIG. 12 is a front perspective view of a preferred embodiment of the apparatus of the present invention showing a female soccer player kicking a soccer ball while moving forward.
Figure 13:
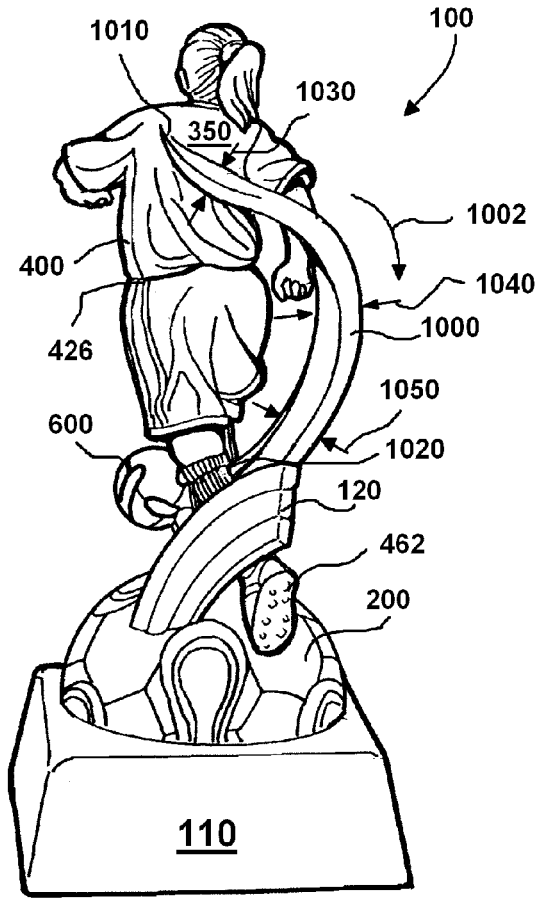
FIG. 13 is a rear perspective view of the embodiment of FIG. 12.
Figure 14:
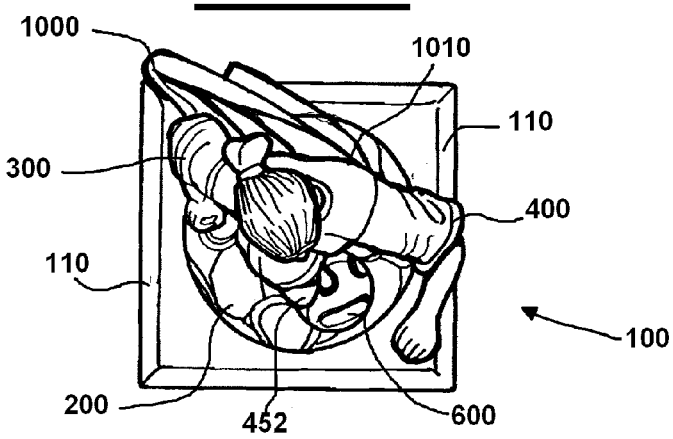
FIG. 14 is a top perspective view of the embodiment of FIG. 12.

In FIGS. 12-14, a female soccer player is the figurine 300 wherein she is dribbling or advancing the game piece or soccer ball 600 as indicated by the movement simulating member 1000 being pushed forward with her foot 452.

Figure 15:
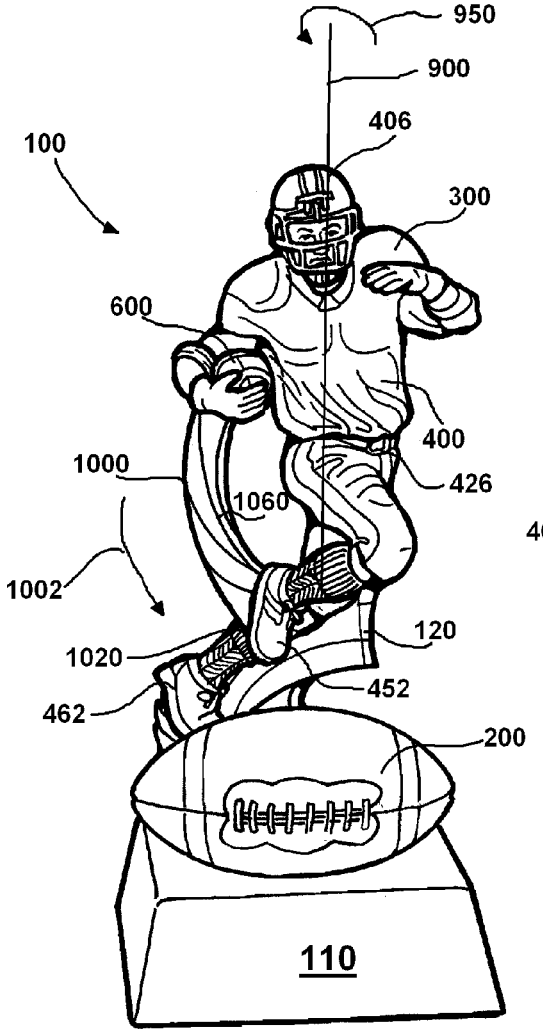
FIG. 15 is a front perspective view of a preferred embodiment of the apparatus of the present invention showing a trophy representing a male football player making a cutting turn with a football such as in an attempt to avoid a defensive player.
Figure 16:
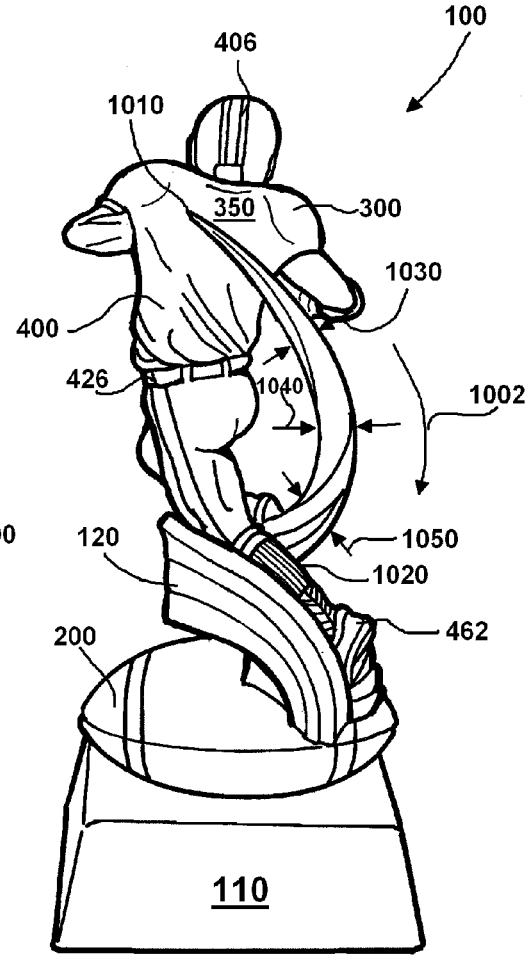
FIG. 16 is a rear perspective view of the embodiment FIG. 15.
Figure 17:
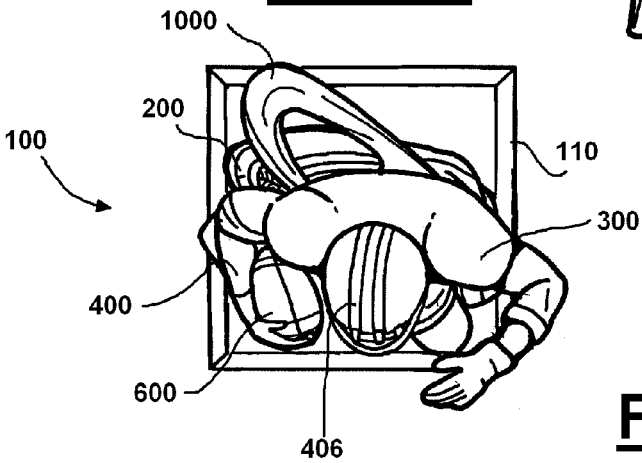
FIG. 17 is a top perspective view of the embodiment of FIG. 15.

In FIGS. 15-17, the figurine 300 is a football player carrying the game piece or ball 600 wherein the movement simulating member 1000 simulates his movement as he cuts or changes direction in order to avoid a tackler.

Figure 18:
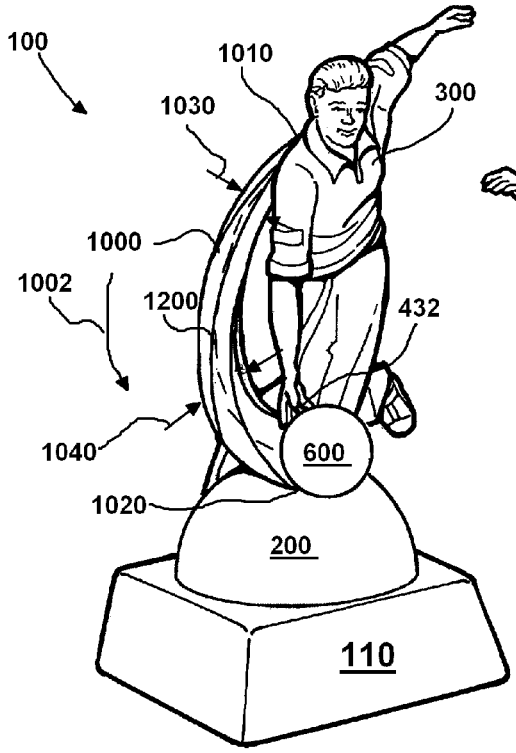
FIG. 18 is a front perspective view of a preferred embodiment of the apparatus of the present invention showing a trophy representing a male player bowling a bowling ball.
Figure 19:
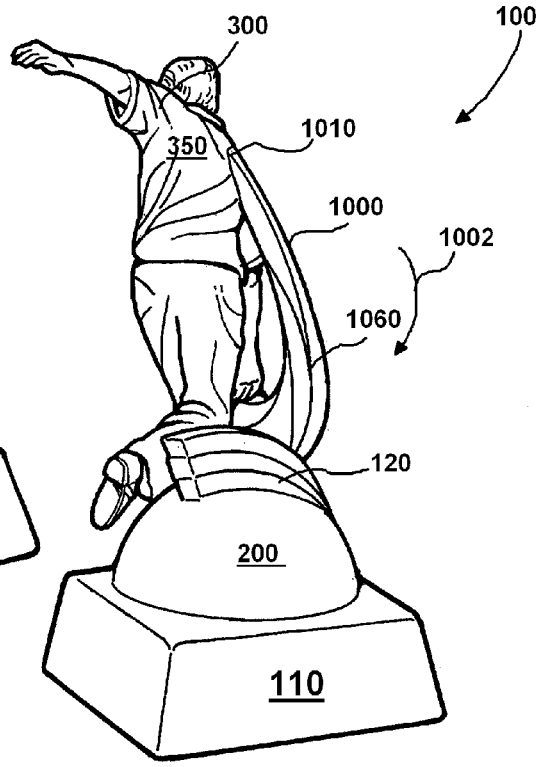
FIG. 19 is a rear perspective view of the embodiment of FIG. 18.
Figure 20:
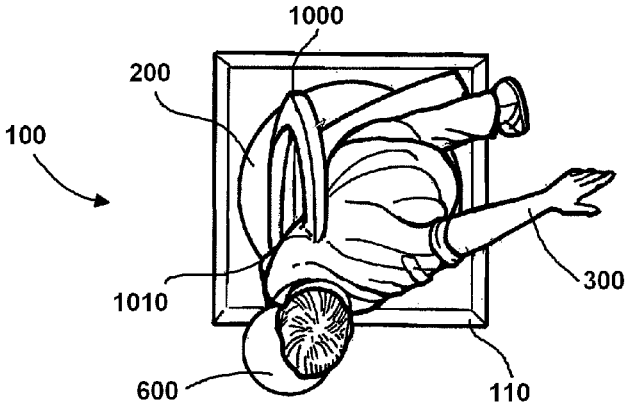
FIG. 20 is a top view of the embodiment of FIG. 18.

In FIGS. 18-20, the figurine 300 is a male bowler bowling a ball game piece 600 wherein the movement simulating member 1000 tracks the arc of his hand and the ball 600 during bowling.

Figure 21:
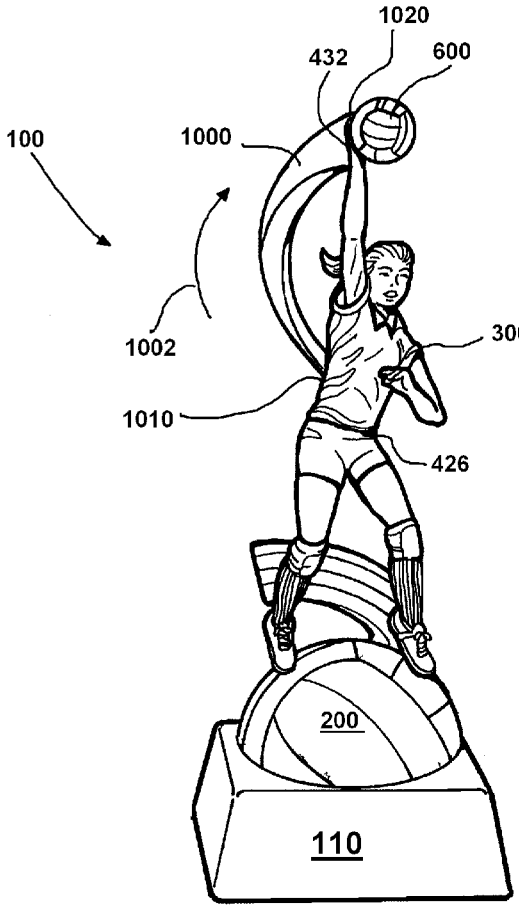
FIG. 21 is a front perspective view of a preferred embodiment of the apparatus of the present invention showing a trophy representing a female volleyball player spiking a volleyball.
Figure 22:
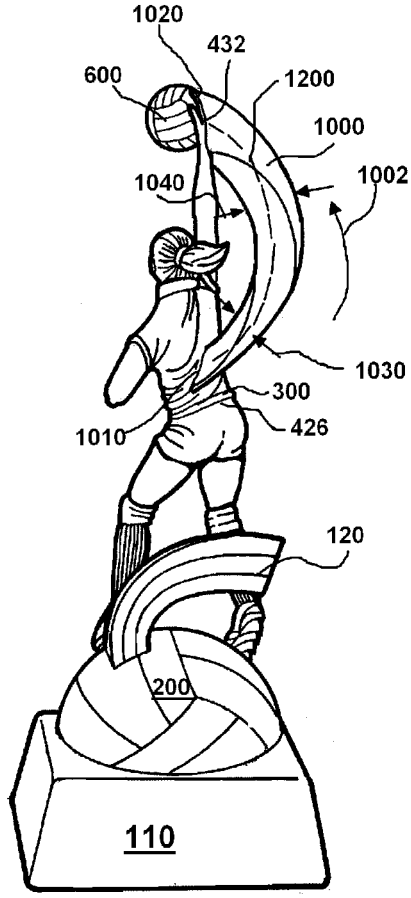
FIG. 22 is a rear perspective view of the embodiment of FIG. 21.
Figure 23:
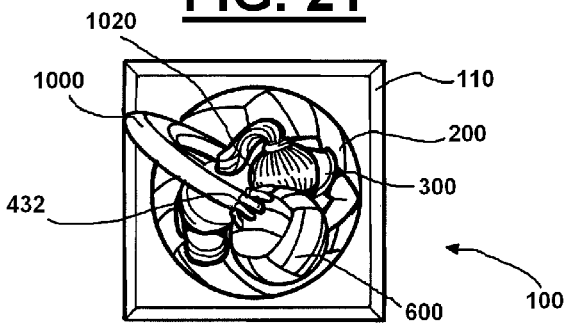
FIG. 23 is a top view of the embodiment of FIG. 21.

FIGS. 21-23 is a female volleyball player as the figurine 300 spiking a volleyball game piece 600 wherein the movement simulating member 1000 tracks her hand 432 and the game piece or ball 600.

Figure 24:
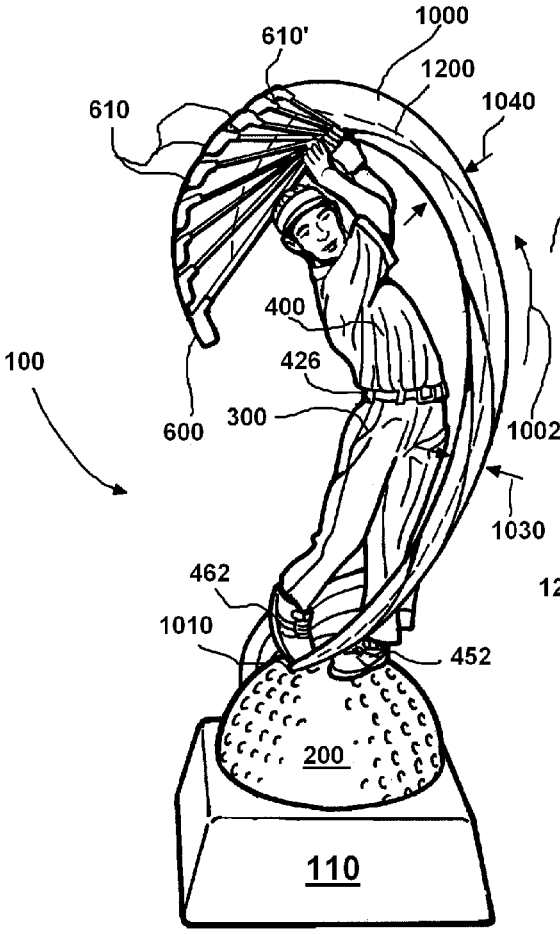
FIG. 24 is a front perspective view of a preferred embodiment of the apparatus of the present invention showing a trophy representing a male golfer making a swing with a golf club.
Figure 25:
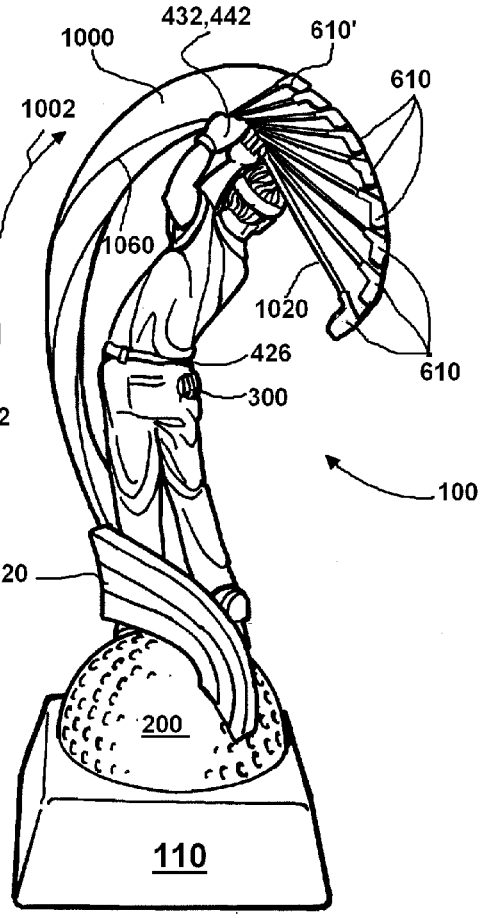
FIG. 25 is a rear perspective view of the embodiment of FIG. 24.
Figure 26:
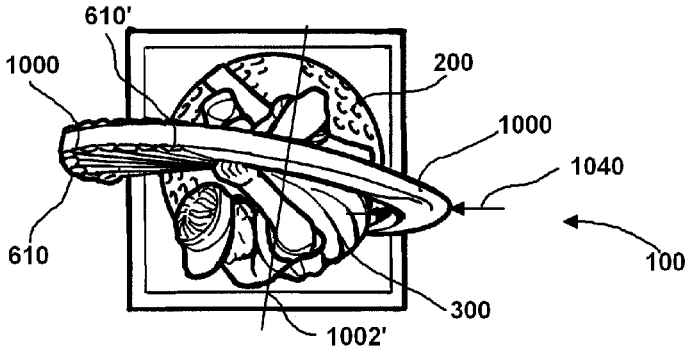
FIG. 26 is a top view of the embodiment of FIG. 24.

FIGS. 24-26 show a male golfer as the figurine 300, wherein the movement simulating member 1000 tracks movement of the golf club game piece 600 and wherein a plurality of phantom positions of the golf club or game piece 600 for the statue or figurine 300 are shown, designated by the numeral 610.

Figure 27:
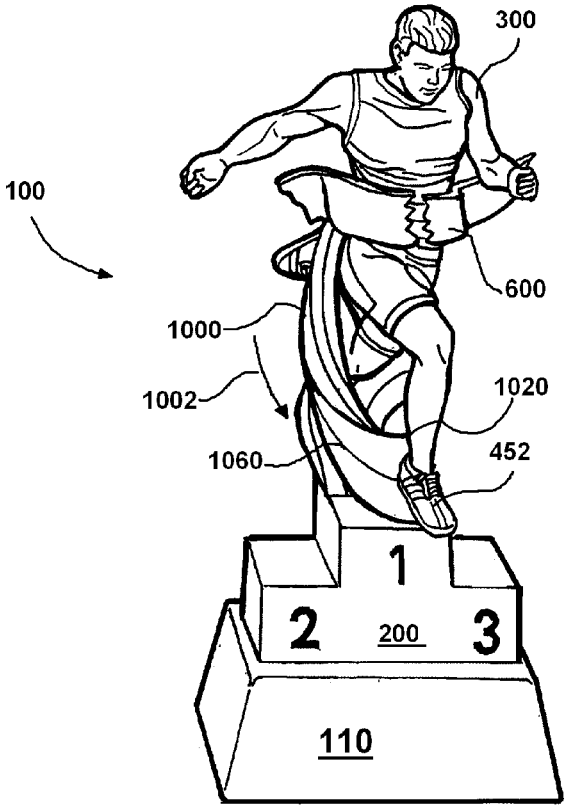
FIG. 27 is a front perspective view of a preferred embodiment of the apparatus of the present invention showing a male runner striking a finish line tape.
Figure 28:
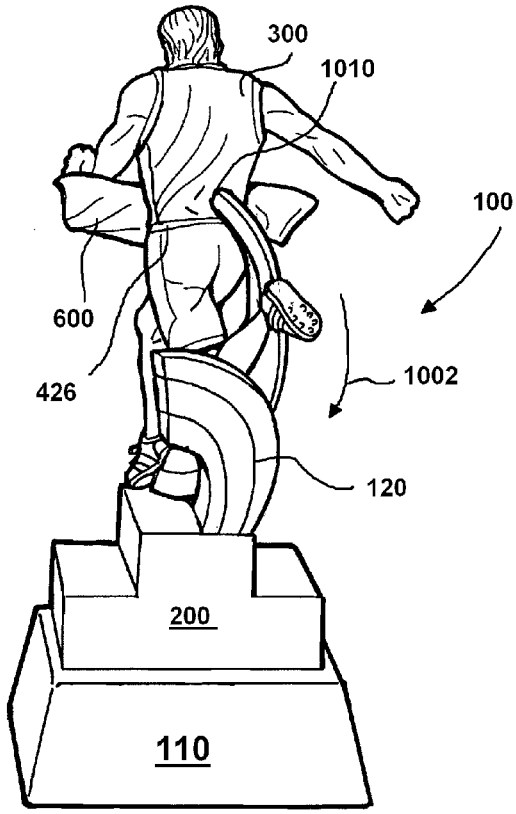
FIG. 28 is a rear perspective view of the embodiment of FIG. 27.
Figure 29:
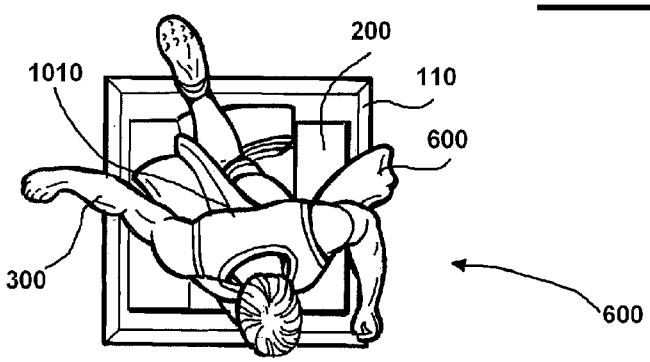
FIG. 29 is a top view of the embodiment of FIG. 27.

In FIGS. 27-29, the figurine 300 is in the form of a male track athlete and wherein the movement simulating member 1000 simulates movement of the athletes right foot 452 as the athlete leans forward in order to strike the game piece 600 in the form of a finish line tape. In FIGS. 27-29, the base game piece 200 is in the form of a podium.

Figure 30:
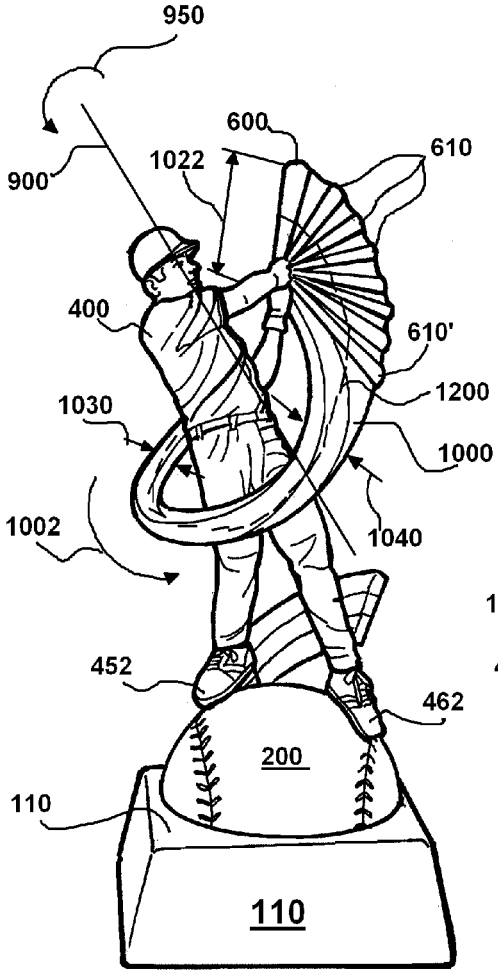
FIG. 30 is a front perspective view of a preferred embodiment of the apparatus of the present invention representing a male baseball player swinging a bat.
Figure 31:
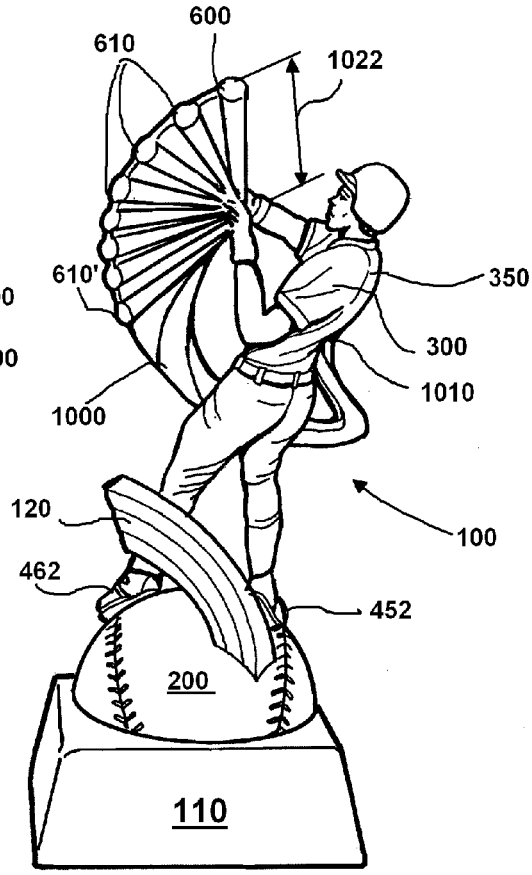
FIG. 31 is a rear perspective view of the embodiment of FIG. 30.
Figure 32:
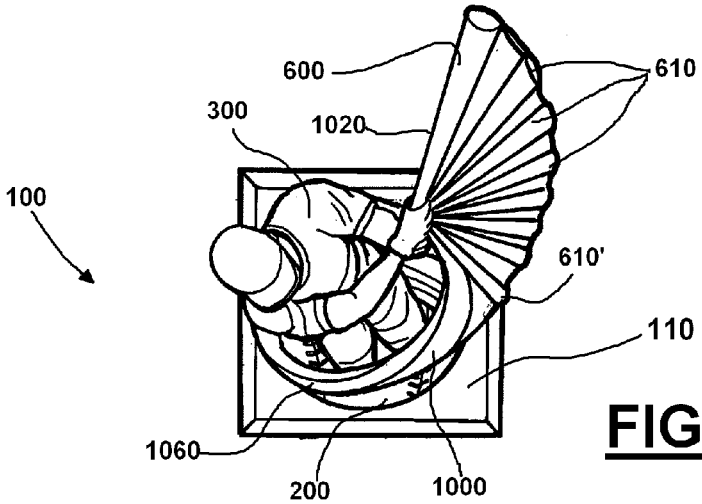
FIG. 32 is a top view of the embodiment of FIG. 30.

In FIGS. 30-32, the figurine 300 is in the form of a male baseball player swinging a game piece 600 in the form of a baseball bat. The movement simulating member 1000 simulates an arc shaped travel of the bat 600 as it is being swung. As with the golfer of FIGS. 24-26, the numeral 610 illustrates phantom positions of the bat 600.

Figure 33:
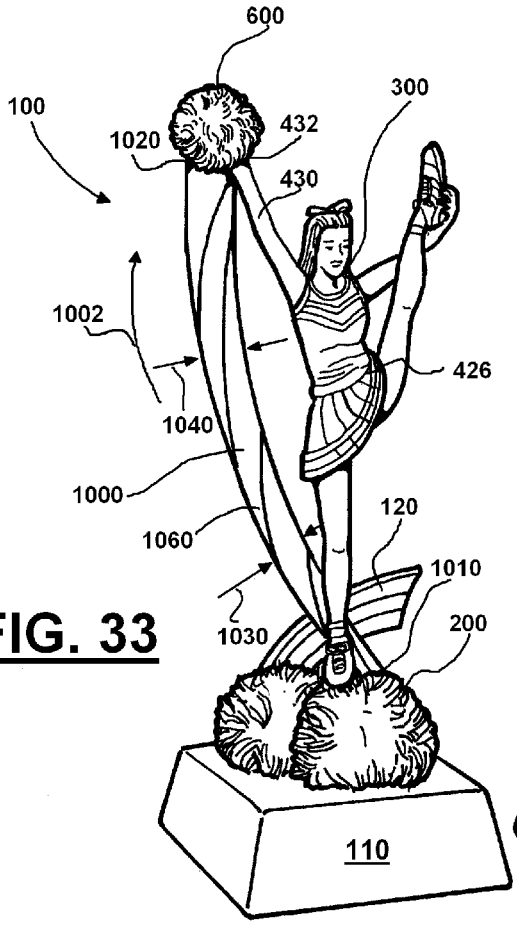
FIG. 33 is a front perspective view of a preferred embodiment of the apparatus of the present invention showing a cheerleader.
Figure 34:
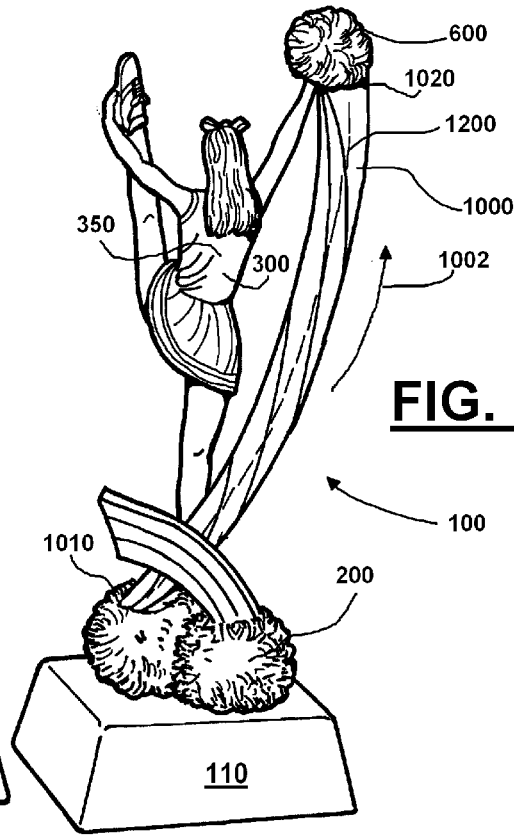
FIG. 34 is a rear perspective view of the embodiment of FIG. 33.
Figure 35:
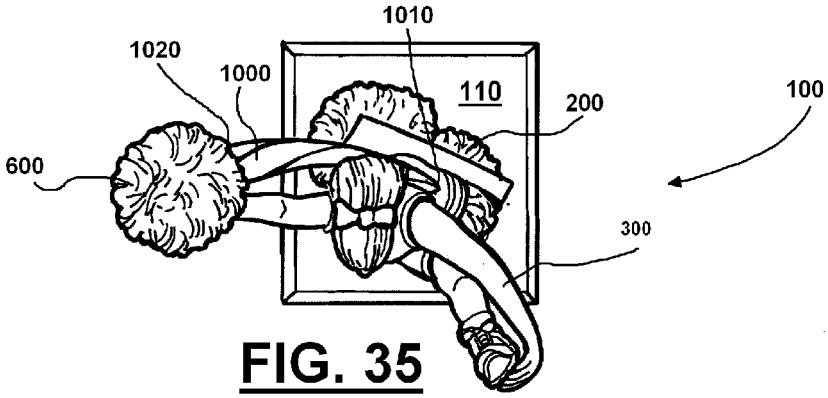
FIG. 35 is a top view of the embodiment of FIG. 34.

FIGS. 33-35 show a figurine 300 in the form of a cheerleader wherein the movement simulating member 1000 illustrates an arc shaped travel of her arm 430 and hand 432 as she swings the arm 430 upwardly carrying a game piece 600 in the form of a decorative ornament, sometimes referred to as a pom pom.

Figure 1:
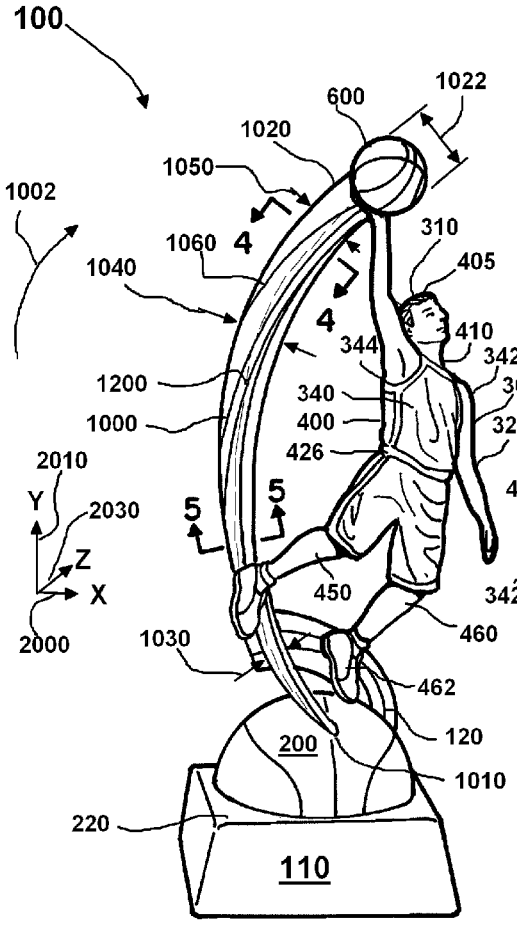
FIG. 1 is a front perspective view of a preferred embodiment of the apparatus of the present invention showing a trophy representing a male basketball player in the process of dunking a basketball.
Figure 2:
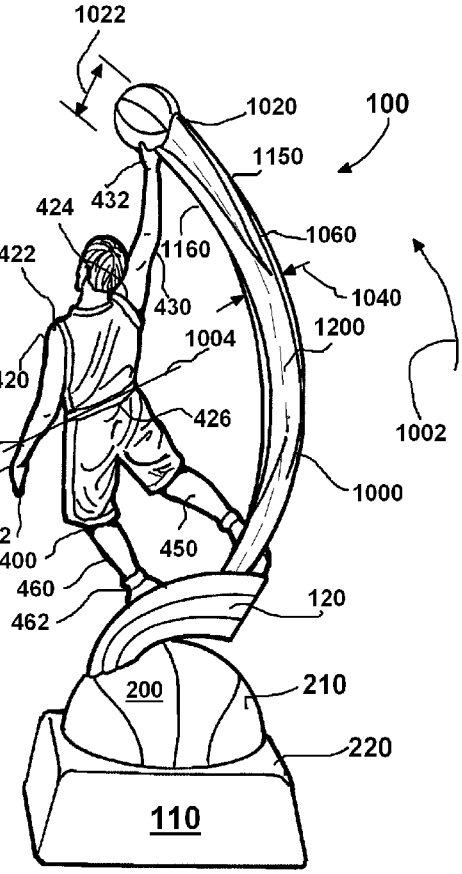
FIG. 2 is a rear perspective view of the embodiment of FIG. 1.
Figure 3:
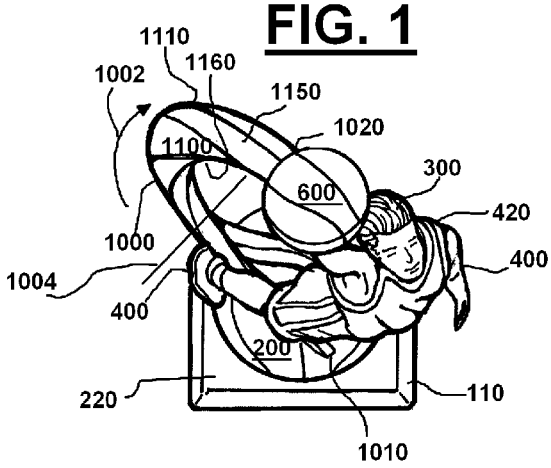
FIG. 3 is a top perspective view of the embodiment of FIG. 1.
Figure 4:
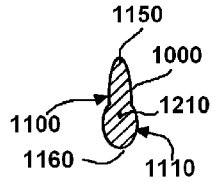
FIG. 4 is a sectional view taken along lines 4-4 of FIG. 1.
Figure 5:
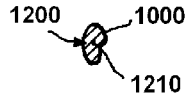
FIG. 5 is a sectional view taken along lines 5-5 of FIG. 1.

In each of the drawings FIGS. 1-35, a trophy or award 100 can include a whole or partial representation of a game piece 200 mounted on base 110, and the statue or figurine 300 can be mounted on game piece 200. Game piece 200 can be a partial game piece such as the half basketball shown in FIGS. 1-3. The half basketball game piece 200 has lower portion 220 that engages or is a part of base 110. Base game piece 200 provides upper portion 210 that supports figurine 300. An auxiliary support 120 can be provided to reinforce the connection of figurine 300 to base 110 or to base game piece 200 as seen in FIGS. 1-3.

In one embodiment statue or figurine 300 can be a three-dimensional depiction of an individual 400 participating in a game or sporting event. The individual 400 can be male or female, and is preferably depicted wearing a uniform for the game being played.

The statue or figurine 300 can comprise top 310, middle 320, and bottom 330. Additionally, statue or figurine 300 can include front 340 and back 350 portions, with left 342 and right 344 sides.

The individual 400 depicted in statue or figurine 300 can have head 405, neck 410, shoulders 420 (left 422 and right 424), waist 426, first arm 430 with hand 432, second arm 440 with hand 442, first leg 450 with foot 452, second leg 460 with foot 462. The individual 400 can be male or female, and is preferably depicted wearing a uniform for the game being played.

In this three-dimensional depiction the individual 400 of statue or figurine 300 can be depicted "captured" in a position or pose during dynamic game play. For example, if the game is golf, the individual shown in the statue or figurine 300 can be captured during a driving golf swing. As other examples, in football the individual with the game piece can be captured making a turn to avoid a pursuer, in baseball the individual can be captured during a bat swing, in soccer the individual can be captured kicking a soccer ball game piece 600, in basketball the individual can be captured during the process of dunking the basketball, or during the process of turning while dribbling the basketball game piece 600.

Movement member 1000 can be an indicia of movement in the statue or figurine 300 from a first position to a second position—either of a game piece 600 and/or body part of individual 400. For example, in FIGS. 1-5 the movement simulating member 1000 simulates movement of both the hand 432 of individual/athlete 400 and also the basketball game piece 600.

A movement member 1000 can be included with the statue or figurine 300. Movement member 1000 can include first end 1010 and second end 1020, and longitudinal centerline 1200. Movement member 1000 can be a three-dimensional shape.

Movement member 1000 can have first longitudinal face 1100 and second longitudinal face 1110, with first 1150 and second 1160 sides connecting first 1100 and second 1110 faces. First 1100 and second 1110 faces can generally increase in size from first end 1010 to second end 1020 of movement member 1000.

A cross section of movement member 1000 made perpendicular to longitudinal centerline 1200 can be generally in the shape of a parallelogram (such as a rectangle), include rounded edges for first 1150 and second 1160 sides, or generally in the shape of an ellipse.

In one embodiment the cross section of movement member 1000 can become circular as it approaches first end 1010.

In one embodiment is disclosed a statue or figurine 300 that may be awarded as a trophy for winning or showing excellence in competition which statue or figurine tracks or depicts dynamic game play.

In one embodiment is disclosed a trophy which comprising a base 110 and a statue or figurine 300 mounted thereon. In one embodiment the statue or figurine 300 comprises a movement member 1000.

In various embodiments the sporting event depicted in the statue or figurine 300 depicts a player in one or more of the following sports: football, basketball, baseball, soccer, volley ball, hockey, tennis, racquetball, pole vaulting, track, high jumping, and/or long jumping.

In one embodiment the base 110 includes at least a partial representation of a game piece 600 of a sport. In one embodiment the base 110 includes a partial representation of a game piece 200. In one embodiment the statue or figurine 300 mounted on the base 110 includes a game piece 600 of the same type and design as the game piece 200 which is part of the base 110. In one embodiment the game piece 600 included in the statue or figurine 300, and the game piece 200 which is part of the base 110, are both colored to match the colors of game pieces in the professional sporting events for such game pieces.

In one embodiment, the statue or figurine 300 for a sport comprises a game piece 600 and/or body part (e.g., 432, 442, 452, and/or 462), and a movement member 1000, the movement member 1000 being coupled to the game piece and/or body part, wherein the movement member 1000 is an indicia of dynamic game play in the sport.

In one embodiment the movement member 1000 can be detachably connected to the game piece 600 and/or body part (e.g., 432, 442, 452, and/or 462). In one embodiment the movement member 1000 is permanently affixed to the game piece and/or body part (e.g., 432, 442, 452, and/or 462). In one embodiment the movement member 1000 provides structural support for the statue or figurine 300 attached to the base 110.

In one embodiment the movement member 1000 spans from the base 110 (which base includes game piece 200) to the statue or figurine 300.

In one embodiment the movement member 1000 tracks movement of the statue or figurine 300 during game play.

In one embodiment the movement 1000 member follows the path of movement previously made in the statue or figurine 300 before the statue or figurine 300 was captured in time.

In one embodiment the statue or figurine 300 includes a three dimensional figure where at least one part of the figure's movement is tracked by the movement member 1000.

In one embodiment the movement member 1000 is indicia of and/or tracks past movement in the statue or figurine 300.

In one embodiment the movement 1000 member is indicia of and/or forecasts future movement in the statue or figurine 300.

In one embodiment the movement member 1000 is indicia of and/or forecasts a combination of past movement and future movement in the statue or figurine 300.

In one embodiment the movement member 1000 is indicia of and/or tracks movement from a first location to a second location.

In one embodiment the first and second locations are indicia of first and second locations of a game piece 600 shown in the statue or figurine 300.

In one embodiment the first and second locations are indicia of first and second positions of a body part (e.g., 432, 442, 452, and/or 462) of the statue or figurine 300. In one embodiment the body part is a hand (e.g., 432 or 442). In one embodiment the body part is a foot (e.g., 452 and/or 462)

In one embodiment the movement member 1000 includes a plurality of phantom positions 610 of the game piece 600 being held by the statue or figurine 300. In one embodiment 2, 3, 4, 5, 6, 7, 8, 9, and/or 10 phantom positions are shown. In various embodiments ranges between any two of the specified number of phantom positions are shown.

In one embodiment the movement member 1000 comprises two longitudinal portions: (a) a first portion 1100 relatively wide in a first direction and (b) a second portion 1110 relatively thin in a second direction, the first direction being substantially perpendicular to the second direction. In one embodiment a cross section through the movement member is about the shape of a rectangle. In one embodiment the shorter sides of the rectangle can be rounded. In one embodiment the cross section can be elliptical or circular.

In one embodiment the first portion 1100 becomes progressively larger as one moves from the first end 1010 of the movement member 1000 to the second end 1020 of the movement member 1000. In one embodiment the first end 1010 is the starting portion of the movement member 1000. In one embodiment the second end 1020 is the ending portion of the movement member 1000.

In one embodiment the movement member 1000 includes a starting portion 1010 and an ending portion 1020. In one embodiment the ending portion 1020 of the movement member 1000 is located adjacent to a game piece 600. In one embodiment the ending portion 1020 of the movement member 1000 is touching a body part (e.g., 432, 442, 452, and/or 462) of the statue or figurine 300, and the body part of the statue or figurine is touching the game piece 600.

In one embodiment the starting portion 1010 of the movement member 1000 approximates a point, and the ending portion 1020 of the movement member 1000 is about the size of the game piece 600 to which the ending portion 1020 is located adjacent to.

In one embodiment the movement member 1000 at the second end 1020 is about as wide as the game piece 600 which is located adjacent the second end 1020 of the movement member 1000.

In one embodiment the movement member 1000 is in the shape of an arc, smooth curve, or a swoosh having a longitudinal center 1200 spanning from the starting point 1010 of the movement member 1000 to the ending point 1020 of the movement member 1000, and which swoosh is at least partially twisted about this longitudinal center 1200.

In one embodiment the movement member 1000 passes out of any plane containing both the first end 1010 of the movement member 1000 and the second end 1020 of the movement member 1000.

In one embodiment the movement member 1000 passes into, through, and out of a plane containing both the starting portion 1010 of the movement member 1000 and the ending portion 1020 of the movement member 1000.

In one embodiment the movement member 1000 forms at least a partial helix. In one embodiment the helix is substantially vertical. In one embodiment the helix is substantially horizontal. In one embodiment the helix is substantially vertical where the indicia of movement in the statue or figurine 300 is rotation about a substantially vertical axis. In one embodiment the helix is substantially horizontal where the indicia of movement in the statue or figurine 400 is rotation about a substantially horizontal axis.

In one embodiment the movement member 1000 is indicia of air motion resulting from movement of the game piece 600 and/or a body part of the statue or figurine 300. In one embodiment the movement member 1000 is indicia of such wind movement. In one embodiment the movement member 1000 is indicia of water movement.

In one embodiment the movement member 1000 includes a plurality of arcs 1060 spaced about the first surface 1100 of the movement member 1000.

In one embodiment the movement member 1000 includes a plurality of curvatures about its first end 1010 to its second end 1020. In one embodiment the movement member 1000 includes a plurality of arcs 1060 spaced about the second surface 1110 of the movement member 1000. In one embodiment the plurality of arcs 1060 have a plurality of curvatures, and the curvatures of each arc is substantially the same as the curvature of the movement member 1000 at the location of the movement member 1000.

In one embodiment the movement member 1000 simulates air flow through space from a first location of a game piece 600 to a second location of the game piece 600 included in the statue or figurine 300.

In one embodiment the movement member 1000 spans across three dimensions to simulate movement of a game piece 600 and/or body part (e.g., 432, 442, 452, and/or 462) of the statue or figurine 300, such as x, y, and z dimensions in a Cartesian coordinate system.

In one embodiment the statue or figurine 300 has a height or top 310 with a middle 320, and the movement member 1000 spans both above and below the middle 320. In one embodiment the middle 320 of the statue or figurine 300 is a waist line 426.

In one embodiment the statue or figurine 300 has a front and a rear, and the movement member 1000 spans from the rear to the front (or vice versa) of the statue or figurine 300.

In one embodiment the statue or figurine 300 has a top 310, and looking from the top 310, the movement member 1000 appears to wrap around the statue or figurine 300 by at least about the following ranges of percent: 30, 35, 40, 45, 50, 55, 60, 65, 70, 75, 80, 85, 90, 91, 92, 93, 94, 95, 96, 97, 98, 99, and 100. In various embodiments the wrap around can be a range between any two of the above specified percentages.

A method is also provided for making an award 100, comprising providing a game piece 600 and/or body part (e.g., 432, 442, 452, and/or 462), and connecting a movement member 1000 to the game piece 600 and/or body part (e.g., 432, 442, 452, and/or 462), wherein the movement member 1000 is indicia of movement from a first to a second position of game piece 600 and/or body part (e.g., 432, 442, 452, and/or 462).

In another instance, a method is provided for making an award 100 comprising providing a game piece 600 and/or body part (e.g., 432, 442, 452, and/or 462), providing a movement member 1000 connected to the game piece 600 and/or body part (e.g., 432, 442, 452, and/or 462), and displaying on the movement member 1000 a plurality of depictions 610 of at least a portion the game piece 600 and/or body part game piece 600 and/or body part (e.g., 432, 442, 452, and/or 462).

The following is a list of parts and materials suitable for use in the present invention.

PARTS LIST

| Part Number | Description |
|---|---|
| 100 | trophy or award |
| 110 | base |
| 120 | auxiliary support |
| 200 | base game piece |
| 210 | upper portion of base game piece |
| 220 | lower portion of base game piece |
| 300 | statue or figurine |
| 310 | top |
| 320 | middle |
| 330 | bottom |
| 340 | front |
| 342 | left side |
| 344 | right side |
| 350 | back |
| 400 | individual |
| 405 | head |
| 406 | hat or cap or helmet |
| 410 | neck |
| 420 | shoulders |
| 422 | left shoulder |
| 424 | right shoulder |
| 426 | waist |
| 430 | first arm |
| 432 | hand |
| 440 | second arm |
| 442 | hand |
| 450 | first leg |
| 452 | foot |
| 460 | second leg |
| 462 | foot |
| 600 | game piece for statue or figurine |
| 610 | plurality of phantom positions of game piece for statue or figurine |
| 900 | rotational axis |
| 1000 | movement member |
| 1002 | curvature of movement member |
| 1004 | general axis of rotation |
| 1010 | first end |
| 1020 | second end |
| 1022 | width of second end |
| 1030 | intermediate width |
| 1040 | intermediate width |
| 1060 | plurality of arcs or curves or breaks |
| 1100 | first longitudinal face portion |
| 1110 | second longitudinal face portion |

-continued

PARTS LIST

| Part Number | Description |
|---|---|
| 1150 | first edge |
| 1160 | second edge |
| 1200 | longitudinal center line |
| 1210 | longitudinal center point |
| 2000 | X-axis |
| 2010 | Y-axis |
| 2030 | Z-axis |

Although the above embodiments are representative of the present invention, other embodiments will be apparent to those skilled in the art from a consideration of this specification and the appended claims, or from a practice of the embodiments of the disclosed invention. It is intended that the specification and embodiments therein be considered as exemplary only, with the present invention being defined by the claims and their equivalents.

We claim:

1. A trophy article, comprising:

a) a statuette assembly that includes a base and three dimensional sculpture of an athlete;

b) the sculpture of an athlete having a torso, legs, feet, arms, hands, and a head, one or more feet resting on the base;

c) a sports implement that is in contact with the statuette assembly; and d) an arc shaped member that simulates movement of a part of the statuette assembly, through an arc shaped path, wherein the arc shaped member is supported by the statuette assembly and provides arc ends and positioning of the arc ends at spaced apart positions on the statuette.

2. The trophy article of claim 1, wherein the arc shaped member connects to the statuette assembly at two spaced apart positions.

3. The trophy article of claim 1, wherein the arc shaped member has a transverse cross section that varies between the ends.

4. An award, comprising: a statue or figurine in a static position for a sporting event, and a member attached to the statue or figurine, the member being an indicia of dynamic game play indicating movement which has occurred of a game piece of the statue or figurine or indicating movement which has occurred of a body part of the statue or figurine.

5. The award of claim 4, wherein the member includes indicia of movement of a game piece from a first position to a second position.

6. The award of claim 4, wherein the member includes indicia of movement of a body part of the statue or figurine from a first position to a second position.

7. The award of claim 4, wherein the base includes a representation of a first game piece, and the statue or figurine is mounted on the first game piece, and the statue or figurine is holding a second game piece, the second game piece being the same type of game piece as the first game piece.

8. The award of claim 4, wherein the member includes a first end and a second end, and the statue or figurine includes a lower portion, middle portion, and upper portion, along with front and back portions, and the member extends from the lower portion to the upper portion, and from the rear to the front portions.

9. The award of claim 4, wherein the member includes a longitudinal centerline, and a plane perpendicular to the centerline cuts the member into a cross section substantially in the shape of an ellipse.

10. The award of claim 4, wherein the statue or figurine is holding a game piece, and the member includes a plurality of phantom game pieces located adjacent the game piece, the plurality of phantom game pieces being incorporated into the member.

11. The award of claim 4, wherein the member includes a longitudinal centerline, and the longitudinal centerline forms at least part of a helix.

12. The award of claim 11, wherein the helix has an axis of rotation, and the statue or figurine has an axis of rotation, and the axis of rotation of the helix is substantially parallel to the axis of rotation of the statue or figurine.

13. The award of claim 12, wherein the axis of rotation of the helix is spaced apart from the axis of rotation of the statue or figurine.

14. A trophy comprising: a statue or figurine in a static position for a sporting event, and a member attached to the statue or figurine, the member being an indicia of dynamic game play indicating movement which has occurred of a game piece of the statue or figurine or indicating movement which has occurred of a body part of the statue or figurine.

15. The trophy of claim 14, wherein the member tracks movement of the statue or figurine during game play.

16. The trophy of claim 14, wherein the statue or figurine includes a game piece, and wherein the member follows the path of movement of the game piece.

17. The trophy of claim 14, wherein the statue or figurine includes a three dimensional figure where at least one part of the figure's movement is tracked by the member.

18. The trophy of claim 14, wherein the member comprises two longitudinal portions: (a) a first portion relatively wide in a first direction and (b) a second portion relatively thin in a second direction, the first direction being substantially perpendicular to the second direction.

19. The trophy of claim 18, wherein the member has a starting point and an ending point, and is in the shape of a swoosh having a longitudinal axis spanning from the starting point of the member to the ending point of the member, and which swoosh is at least partially twisted about this longitudinal axis.

20. The trophy of claim 18, wherein the member has a first end and a second end, and passes out of any plane containing both the first end of the member and the second end of the member.

21. The trophy of claim 18, wherein the member has a starting portion and ending portion, and passes into, through, and out of a plane containing both the starting portion of the member and the ending portion of the member.

22. The trophy of claim 18, wherein the member forms at least a partial helix.

23. The trophy of claim 18, wherein statue or figurine includes a game piece, and the member simulates air flow through space from a first location of a game piece to a second location of the game piece.

24. The trophy of claim 18, wherein statue or figurine includes a game piece, and the member spans across three dimensions to simulate movement of a game piece and/or body part of the statue or figurine in the x, y, and z dimensions in a Cartesian coordinate system.

25. The trophy of claim 18, wherein the statue or figurine has a front and a rear, and the member spans from the rear to the front of the statue or figurine.

26. The trophy of claim 18, wherein the statue or figurine has a top, and looking from the top, the member appears to wrap around the statue or figurine by at least about thirty percent.

27. The trophy of claim 14, wherein the statue or figurine has a height with an upper portion, a middle portion and a lower portion, and the member spans both above and below the middle portion.

* * * * *